United States Patent [19]

Lindsey et al.

[11] Patent Number: 4,984,639

[45] Date of Patent: Jan. 15, 1991

[54] DEMOLITION HAMMER

[75] Inventors: Edgar F. Lindsey, 10370 Worthington Hills Manor, Roswell, Ga. 30076; Stephen G. Moran, Atlanta, Ga.

[73] Assignee: Edgar F. Lindsey, Buford, Ga.

[21] Appl. No.: 414,717

[22] Filed: Sep. 29, 1989

[51] Int. Cl.[5] ..... E21C 27/30

[52] U.S. Cl. ..... 173/100; 173/119

[58] Field of Search ..... 173/94, 100, 119, 139

[56] References Cited

U.S. PATENT DOCUMENTS

| | | | |
|---|---|---|---|
| 941,093 | 11/1909 | Painter | 173/100 |
| 1,921,503 | 8/1933 | Calderwood | 173/100 |
| 2,425,018 | 8/1947 | Williams | 173/100 |
| 3,150,724 | 9/1964 | Oelkers | 173/100 |
| 3,922,017 | 11/1975 | Cobb | 173/94 |

FOREIGN PATENT DOCUMENTS

| | | | |
|---|---|---|---|
| 164576 | 11/1949 | Fed. Rep. of Germany | 173/100 |
| 1273973 | 5/1972 | United Kingdom | 173/100 |

*Primary Examiner*—Douglas D. Watts
*Assistant Examiner*—Scott A. Smith
*Attorney, Agent, or Firm*—Jones, Askew and Lunsford

[57] ABSTRACT

A demolition hammer intended for attachment to a bracket or the like. The demolition hammer includes an adapter bracket which connects to the arm of a backhoe in place of the conventional bucket of the backhoe, and a hammer head spaced apart from the adapter bracket by a hammer spring arm cantilevered or pivotably mounted with respect to the adapter bracket. Repeated operation of the backhoe hydraulic cylinder which normally pivots the bucket will instead move the hammer into repetitive impacts with the concrete or other work surface undergoing demolition. The flexibility of the hammer spring adds a whipping action which increases the effective impact of such movement.

6 Claims, 5 Drawing Sheets

DEMOLITION HAMMER

FIELD OF INVENTION

This invention relates in general to demolition apparatus, and relates in particular to a demolition hammer intended for attachment to existing machinery such as a backhoe or the like.

BACKGROUND OF THE INVENTION

Demolition of existing masonry or concrete surfaces generally require subjecting those surfaces to repeated impacts containing enough energy to destroy the structural integrity of the surface. Existing pavement, bridges, decks, and the like are typical of surface structures which require demolition for replacement by different construction or, particularly in the case of pavement, to remove the existing surface before rebuilding the pavement.

The conventional air-powered jackhammer for many years was the tool of choice for breaking up existing pavement or other masonry structures. However, the conventional jackhammer is a relatively slow and labor-intensive tool and its use is not efficient in many applications, for example, for breaking up relatively large expanses of concrete deck or pavement. Attempts to overcome this known inefficiency have included mounting a jackhammer on a tractor or similar vehicle, thereby allowing the tractor operator to position the jackhammer without having to personally manhandle that relatively-heavy object. This approach, while for many applications an improvement over a jackhammer positioned by an individual operator, still requires a separate air compressor or other power source to operate the jackhammer, external from the tractor which carries the jackhammer.

Also known in the prior art are demolition vehicles designed for that particular purpose and limited to that application. These vehicles generally are self-contained and self-propelled for movement along a roadway or other surface undergoing demolition, and include a tool for impacting that surface. One such vehicle is shown in U.S. Pat. No. 3,133,730. Such special-purpose demolition vehicles are very expensive to acquire and operate, and thus are beyond the reach of the small contractor who has occasional demolition work but cannot justify purchasing expensive equipment useful only for that one purpose.

SUMMARY OF THE INVENTION

Stated in general terms, the demolition hammer of the present invention is particularly designed and intended for easy attachment to existing power equipment such as a backhoe or the like, thereby adapting the backhoe for use in demolition work. The present demolition hammer is easily mounted in place of the conventional bucket scoop used on a backhoe and strikes hammer blows against the existing structure or other work surface in response to manipulation of controls existing on the backhoe, so that the demolition hammer does not require connection to a source of hydraulic or pneumatic power in use.

Stated somewhat more specifically, the present demolition hammer includes an adapter member which mounts on the boom of a backhoe in place of the existing bucket, and has a spring arm extending outwardly to support a work tool. This work tool can have a hammer head for striking blows on a surface undergoing demolition, and is alternatively adaptable to various kinds of heads including a chisel point for demolition use and a compaction head enabling the demolition hammer to function as a tool for compacting fill dirt. The spring arm preferably is a spring somewhat in the shape of a cantilever spring, supported to the backhoe adapter at one end and to the hammer or other work tool at the other end. In use, this spring provides a whipping action as the backhoe operator alternately extends and retracts the cylinder which normally controls the bucket, and which moves the present demolition tool to and fro in relation to the surface being impacted. This whipping movement of the spring arm intensifies the energy delivered by each blow of the hammer head or other work tool, so that the operating movement available with the existing movements of a backhoe bucket becomes ample for demolition purposes. A preferred embodiment of the demolition hammer has a hammer spring reduced in thickness toward the hammer end, to increase flexing movement of the spring in use. Alternative embodiments employ an articulated hammer arm spring-biased for flexing movement in use, and a cantilever spring pivotably attached to the adapter member and held by auxiliary springs which maintain a nominal attitude of the hammer spring.

Accordingly, it is an object of the present invention to provide an improved demolition hammer or the like.

It is another object of the present invention to provide a demolition hammer readily adaptable for use with existing power equipment such as a backhoe or the like.

It is further object of the present invention to provide a relatively inexpensive demolition hammer intended for use with existing power equipment.

Other objects and advantages of the present invention will become more apparent from the following description.

DETAILED DESCRIPTION OF PREFERRED EMBODIMENTS

Figure 1:
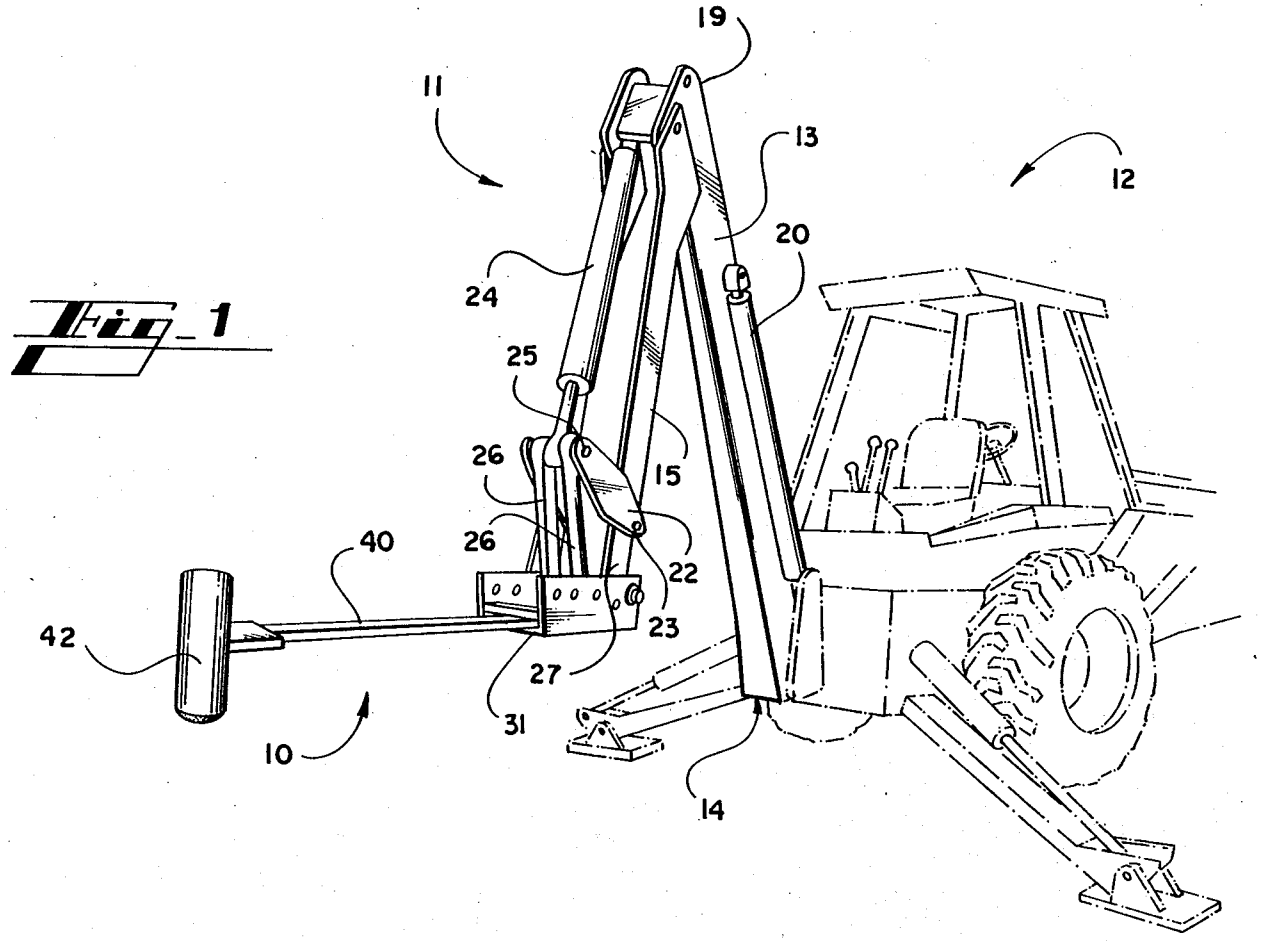
FIG. 1 is a pictorial view showing a first preferred embodiment of the present demolition hammer attached to a conventional backhoe.

Turning first to FIG. 1, there is shown generally at 10 a demolition hammer according to the present invention and attached to a conventional backhoe 11 mounted on a tractor 12. The backhoe 11 includes a boom 13 extending generally upwardly from the swivel mount 14, and has an arm 15 pivotably attached at the outer end 19 of the boom. Hydraulic cylinders 20 (only one being shown in the drawings) mounted on either side of the boom 13 raise and lower the outer end 19 of the boom, and another hydraulic cylinder (not shown) connects to the arm 15 and controls the angular elevation of that arm with respect to the outer end of the boom.

The pivot assembly 22 is connected to the outer end of the arm 15 by the hinge pin 23, and a hydraulic cylinder 24 connects to the outer end 25 of the pivot assembly. A pair of links 26 extend downwardly from the outer end 25 of the pivot assembly 22. The outer ends of the links 26, together with the outer end 27 of the arm 15, form the connecting points to a scoop or bucket (not shown) in a conventional backhoe. Those skilled in the art will recognize that the structure thus far described is conventional for back hoes in general, and that further details about the construction and functioning of such backhoes are known to those of ordinary skill in the art.

Figures 2, 3:
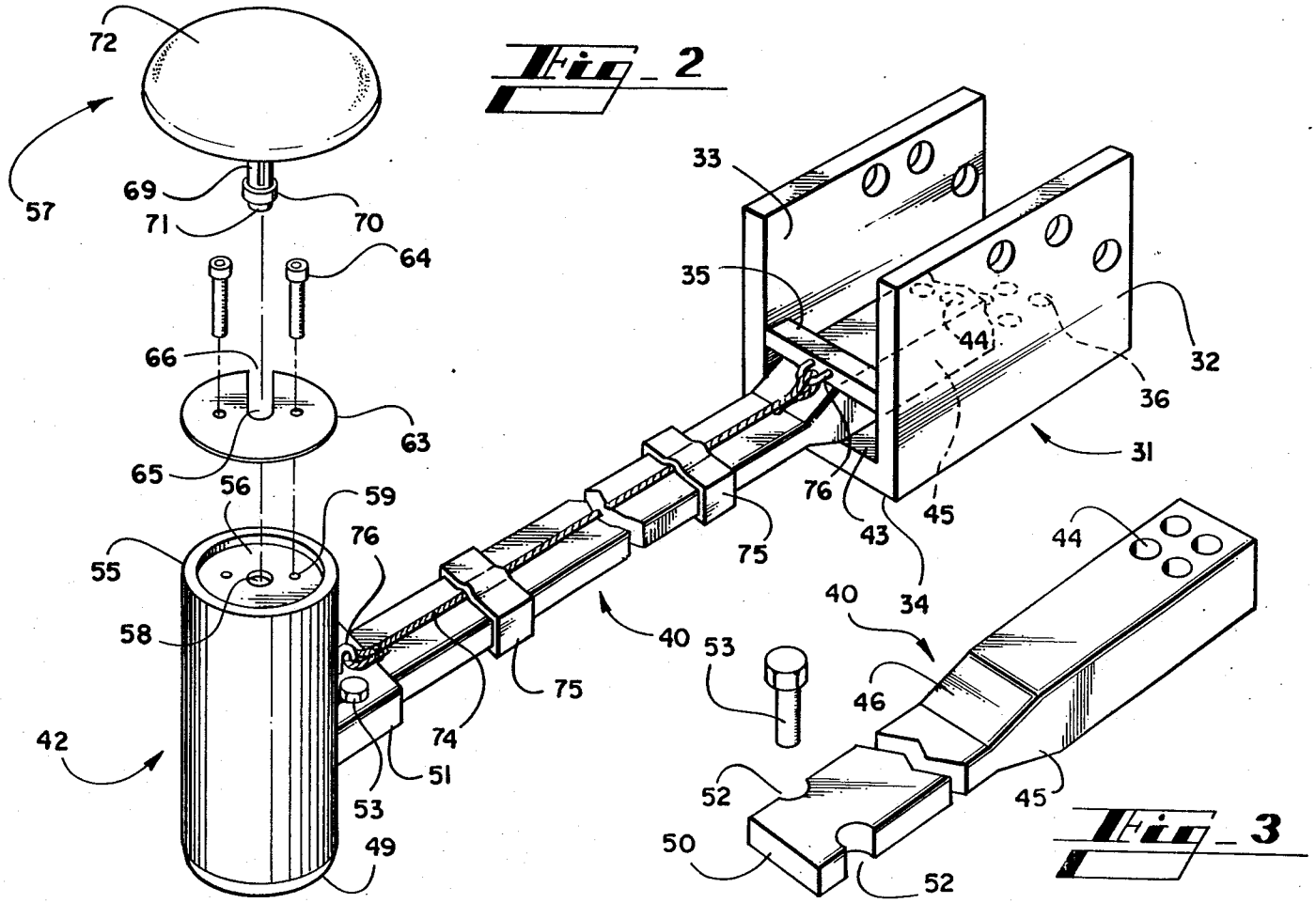
FIG. 2 is a detailed pictorial view showing the demolition hammer assembly of FIG. 1, including an optional compaction head shown in exploded view.
FIG. 3 is an exploded partial view, broken away for drawing purposes, of the spring arm used in the embodiment shown in FIGS. 1 and 2.

The demolition hammer 10 includes an adapter bracket 31 configured for attachment to the links 26 and to the outer end 27 of the backhoe arm 15 in the manner of the conventional backhoe bucket which the adapter bracket replaces. The adapter bracket 31 is best seen in FIG. 2 and includes a pair of side plates 32 and 33 in spaced apart relation with each other, and extending upwardly from the sides of the bottom plate 34. A bulkhead 35 is secured between the facing inner walls of the side plates 32 and 33, spaced a distance above the upper side of the bottom plate 34. That bottom plate has a series of holes 36 formed therethrough, as seen in the cutaway region on the side plate 32.

A hammer spring 40 extends from the adapter bracket 31 to the hammer head 42, making up the work tool of the demolition hammer in the disclosed embodiment. An inner end 45 of the hammer spring 40 extends into the adapter bracket 31 through the gap 43 formed between the bottom plate 34 and the bulkhead 35 of the adapter bracket. A series of holes 44 are formed through the hammer spring 44 near the inner end 45 of that spring as best shown in FIG. 3, and those holes align with the holes 36 formed in the bottom plate 34 of the adapter bracket. The hammer spring 40 thus is securely yet removably connected to the adapter bracket 31 by means of bolts (not shown) which extend downwardly through the aligned holes 44 and 36 and are secured by nuts on the underside of the bottom plate 34. The underside of the bottom plate 34 may be provided with a channel or other recessed region to receive the nuts and threaded ends of the bolts that secure together the hammer spring 40 and the adapter bracket 31, so as to protect the nuts and bolt ends from damage while the demolition hammer is in use.

The hammer spring 40 is an elongated unitary leaf spring member made of steel, which supports the hammer head 42 at the outer end 50 of the hammer spring in cantilever fashion relative to the adapter bracket 31. The hammer spring of the first preferred embodiment is rectangular in cross-section throughout its length. The inner end 41 of the hammer spring 40 is larger in thickness, measured in the vertical dimension as seen in FIG. 3, than the remaining length; the upper and lower surfaces of the hammer spring taper inwardly at 46, located a short distance outside the adapter bracket 31, to provide a reduced thickness over the remaining length of the hammer spring. The longitudinal extent of the hammer spring is subjected to flexing or whipping movement in use thus is thinner than the spring portion held within the adapter bracket. This improves the flexibility of the hammer spring without weakening the hammer spring at its attachment to the hammer bracket, and promotes the effectiveness of the demolition hammer by increasing the terminal velocity of the hammer head 42 on impact with the surface undergoing demolition. In an actual embodiment of the present invention, the hammer spring has an overall length of 96 inches and a width of four inches. The thickness at the inner end 41 is two inches, tapering at 46 to one inch along the remaining length of the spring. It should be understood that those specific dimensions are illustrative and are not intended as limits.

The particular steel material and heat treating for the hammer spring 40 is selected to provide the desired durability and resistance to fracturing given the weight of a particular hammer head 42, the free length of the hammer spring between the hammer head at one end of the hammer spring and the constraint imposed at the other end thereof by passage of the hammer spring through the gap 43, the desired spring rate of the hammer spring, and the cross-sectional dimensions of the hammer spring. These factors are interrelated in ways known to those skilled in the art, and to some extent the factors require experimentation to provide the optimum results desired for a particular application. Although a hammer spring made of steel presently is believed to provide the greatest durability combined with other factors, non-metallic hammer springs made of materials such as kevlar or carbon fiber-reinforced composites are possible alternatives.

The hammer head 42 is of generally cylindrical shape, although rectangular or other shapes are also appropriate. The hammer end 49 of the hammer head is generally blunt in shape and massive of construction, being sufficiently durable to withstand repeated hammer blows to hard materials such as concrete, rock, or the like. The hammer end 49 and, for that matter, the main body of the hammer head 42 may suitably be fabricated from a material such as cast iron, steel, or the like.

The hammer head 42 attaches to the end 50 (FIG. 3) of the hammer spring 40 by means of a sleeve 51 attached to the approximately longitudinal mid-point of the hammer head 42 and extending radially outwardly therefrom. The socket 51 is hollow and snugly receives the end 50 (FIG. 3) of the hammer spring, so that the semicircular notches 52 cut in the opposing sides of the hammer spring become aligned with corresponding holes formed in the upper and lower sides defining the socket 51. A separate bolt 53 extends through each aligned pair of holes formed in the socket 51 and engages one of the notches 52 formed in the sides of the hammer spring 40, thus securely fastening the socket 51 and the hammer head 42 to the end 50 of the hammer spring. The bolts 53 are held in place by nuts or the like (not shown).

It will now be understood that the socket 51 permits easy removal and replacement of the hammer head 42 on the hammer spring 40. Moreover, the position of the hammer head 42 is easily reversible, placing the hammer end 49 uppermost and placing the other end 55 of the hammer head in a lowermost position. This interchangeable positioning of the hammer head 42 allows the use of other work tools with the basic demolition hammer 10. For that purpose, the end 55 of the hammer head 42 includes a socket assembly 56 for receiving optional work tools such as the compaction head 57 shown in exploded relation to the hammer head in FIG. 2. The socket 56 includes an axial opening 58 in the hammer head 42, flanked by two threaded smaller holes 59. A lock plate 63, having substantially the same diameter as that of the hammer head 42, fits over the end 55 of the hammer head and is secured in place by means of fasteners 64 which engage the holes 59 in the socket 56. The lock plate 63 has a radial slot 65 extending from an inner end substantially coaxial and coextensive with the axial opening 58 in the end 55, to an open outer end 66 at the periphery of the lock plate. This slot 65 accommodates the axial stem 69 on the underside of the compaction head 57. A collar 70 near the outer end 71 of the axial stem 69 is of diameter greater than the width of the radial slot 65 in the lock collar 63. Other locking arrangements can be used for locking the optional work tool to the hammer head.

The compaction head 57 is attached to the hammer head 42 by placing the compaction head on the end 55 with the tip 71 of the axial stem 69 fitting into the axial opening 58 of that end. The lock collar 63 then is attached over the end 55 and secured thereon by means of the fasteners 64. The lock collar 63 at this time engages the collar 70 on the axial stem 69 of the compaction head 57, thereby securing the compaction head in place on the end 55 of the hammer head. The outer face 72 of the compaction head 57 is generally of domed or mushroom shape, for maximizing the compaction area when that head is in use as described below.

It will be understood that the compaction head 57 is but one example of alternative work tools attachable to the hammer head 42. Another example of such work tools is a chisel-pointed tool providing maximum focussed impact for breaking relatively hard materials such as certain rocks or hardened concrete.

Figure 4:
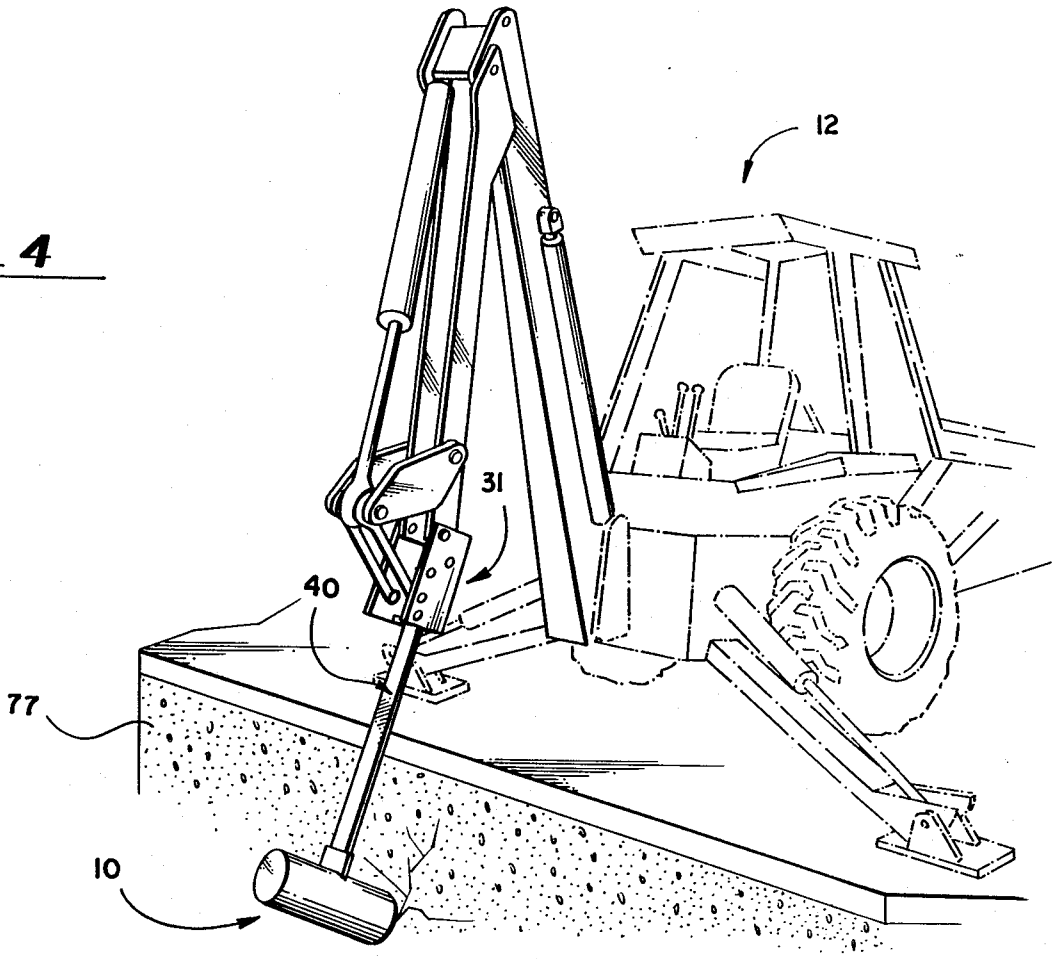
FIG. 4 is a pictorial view showing the present demolition hammer in use on a vertical surface.

The operation of the demolition hammer 10 should now be apparent. The demolition hammer first is attached to a backhoe 11 by removing the bucket normally connected to the pivot assembly 22, and attaching the adapter bracket 31 in place of the bucket. With this substitution completed, the backhoe operator can raise and lower the hammer spring 40 by alternately contracting and extending the hydraulic cylinder 24 mounted on the arm 15 and connected to the outer end 25 of the pivot assembly 22. The pivot assembly 22 and the links 26 thus form an articulated linkage which pivots the adapter bracket 31 upwardly and downwardly around the hinge pin 23. This pivoting motion under control of the backhoe operator raises and lowers the hammer head 42, and proper positioning of the backhoe boom 13 and arm 15 causes the hammer end 49 of the hammer head to strike repeated blows onto a surface being demolished. Through experience using actual embodiments of the present invention, it has been learned that the up-down stroke of the hammer head 42 need not be especially great, nor the downward velocity be particularly large, to impart hammer blows effective to crumble reinforced concrete decking or similar structures. Thus, the extent and speed of movement available with the hydraulic cylinder 24 of a conventional unmodified backhoe combines with the elasticity of the cantilever spring 40 to create a whipping action as the hammer descends to strike the work surface, resulting in impacts more than adequate to achieve effective demolition using the demolition hammer 10. Demolition over an extensive range of positions is possible by maneuvering the backhoe boom 13 and arm 15 to their maximum reach, and by periodically moving the tractor 12 as necessary to reposition the demolition hammer 10 for a new extent of work area to undergo impact. For example, FIG. 4 shows the demolition hammer 10 in use demolishing a vertical surface 77 located below the surface supporting the tractor 12. A practical application of this usage is found in bridge repair, where the existing sides of a bridge must be removed for replacement or widening.

As pointed out previously, the hammer head 42 can be provided at its other end 55 with a work tool such as a chisel head, and the entire hammer head 42 can be removed and repositioned on the hammer spring if necessary to break up a particularly hard material.

A safety cable 74 extends from the adapter bracket 31 to the hammer head 42 to prevent unconstrained travel of the hammer head if the hammer spring 40 were to break while the demolition hammer is being used. The safety cable 74 lies along the hammer spring 40 and is held in place thereon by the cable clamps 75. Eyelets formed at the ends of the safety cable are secured to hooks 76 on the socket 51 of the hammer head and on the bulkhead 35 of the adapter bracket, permitting easy attachment and removal of the safety cable as needed.

Figure 5:
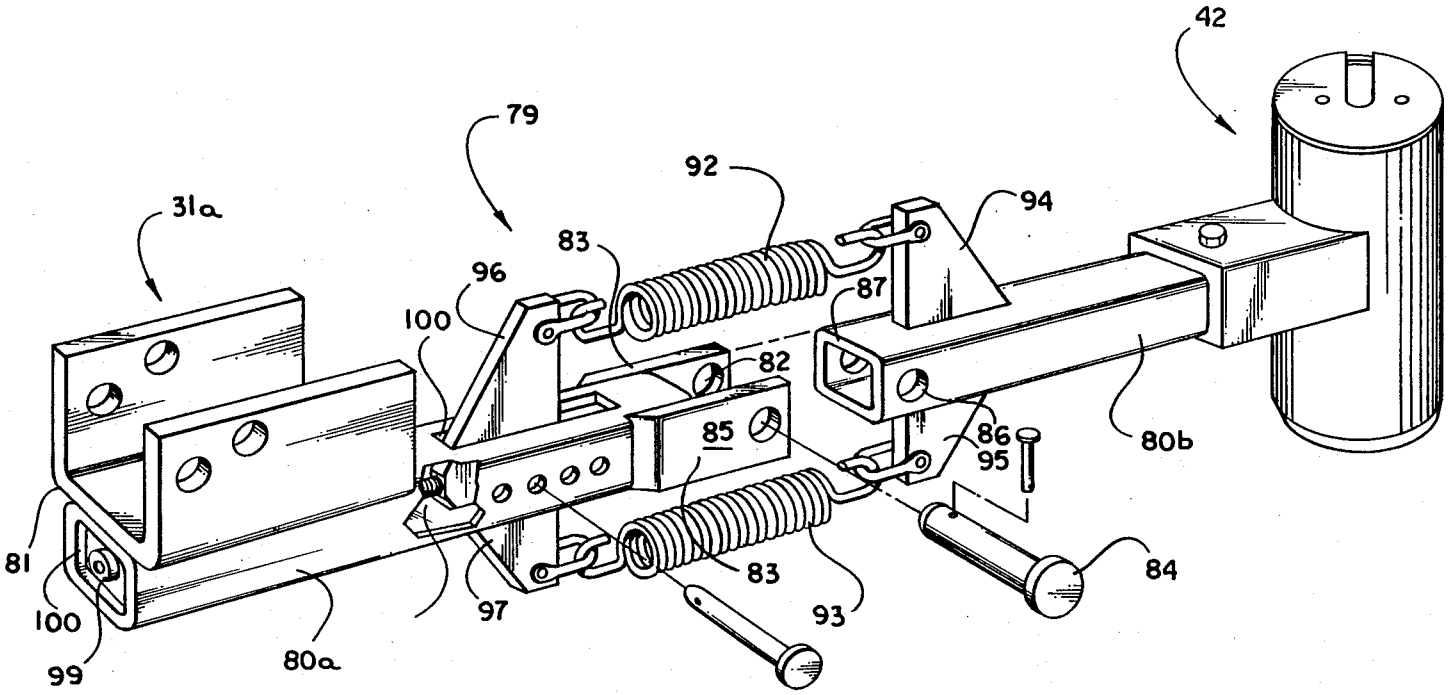
FIG. 5 is a pictorial view showing a first alternative embodiment of demolition hammer according to the present invention.

FIG. 5 shows an alternative embodiment 80 of a demolition hammer according to the present invention. The demolition hammer 80 includes an adapter bracket **31*a* for attachment to the links 26 and the outer arm 27 of the backhoe arm 15 in place of the conventional backhoe bucket, as with the embodiment disclosed in FIGS. 1–4. Extending outwardly from the adapter bracket 31*a* is an articulated hammer arm comprising an inner arm 80*a* and an outer arm 80*b*. One end of the inner arm 80*a* is affixed to the underside 81 of the channel-shaped adapter bracket 31*a*, and the inner arm extends rearwardly from the adapter bracket to terminate at the remote end 82. The hinge plates 83 are secured to opposite sides of the remote end 82, with trailing portions of the hinge plates extending rearwardly beyond the remote end. The outer arm 80*b* is secured to the inner arm 80*a* by a pivot pin 84 which extends transversely through openings 85 in the trailing portions of the hinge plates 83, and through matching transverse openings 86 formed in the lateral sides of the outer arm adjacent the near end 87 thereof. A cross pin 88 holds the pivot pin 84 in place. The hammer head 42 is secured to the far end of the outer arm 80*b*** in the manner described above with respect to the firstmentioned embodiment.

The inner arm **80*a* and the outer arm 80*b* are also connected together by means of the tension springs 92 and 93 respectively located above and below the pivotable connection provided by the pivot pin 84. These springs 92 and 93 are secured at one end to the fins 94 and 95 extending outwardly in fixed relation from the top and bottom sides of the outer arm 80*b* adjacent the near end 87. The other ends of the springs 92 and 93 are connected to the fins 96 and 97 extending outwardly from the top and bottom sides of the inner arm 80*a* adjacent the remote end 82. The fins 96 and 97 associated with the inner arm 80*a* preferably are longitudinally movable along the inner arm 80*a*, for the purpose of adjusting the prefixed tension applied to the springs 92 and 93. This adjustment against the force of the springs 92 and 93 is provided by means of an elongate threaded rod longitudinally mounted within the inner arm 80*a* and terminating at the adjustment nut 99 accessible within the near end 100 of the inner arm. The fins 96 and 97 are attached to a threaded member which engages the screw, and the fins extend through slots 100 (only one of which appears in FIG. 5) to permit a range of longitudinal movement relative to the inner arm 80*a*. The safety pin 98 extends through one of the transverse holes 98***a* in the sides of the inner arm 80*a* and engages a mating hole on the movable fins 96, 97, thereby locking those fins at any one of several discrete positions.

The demolition hammer 79 operates in much the same manner as the demolition hammer 10 described above, except that the inner and outer hammer arms 80*a* and 80*b* are relatively rigid. The flexibility of the hammer arm instead is provided by the pivotable attachment of the inner and outer arms, and by the springs 92 and 93 acting on the outer arm 80*b*. The outer arm 80*b* and the attached hammer head 42 thus exhibit a flexing or whipping movement, relative to the inner arm 80*a* and the adapter bracket 31*a* driven by the backhoe outer arm, as the demolition hammer 79 is moved up and down by the backhoe operator, thereby enhancing the impact of the hammer head.

Figure 6:
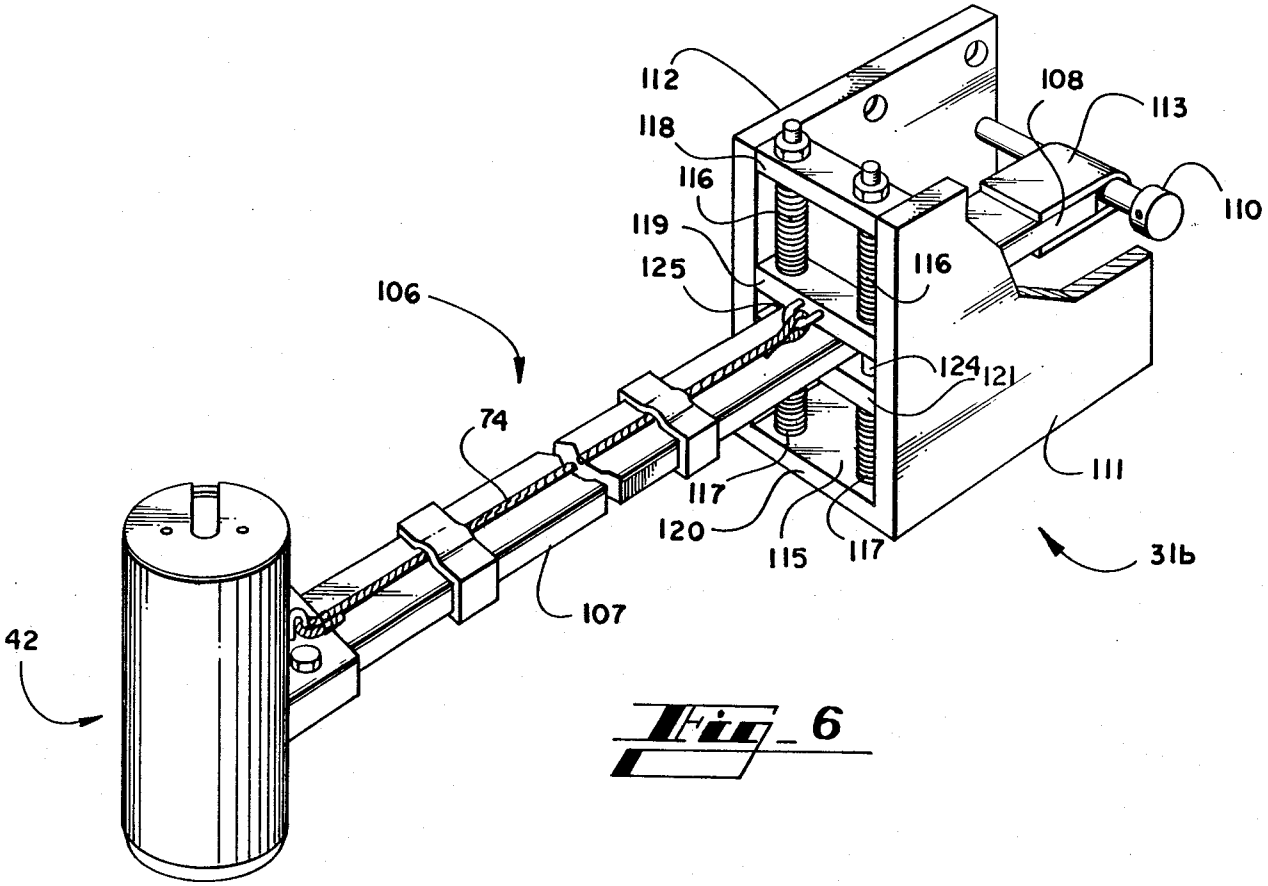
FIG. 6 is a pictorial view showing a second alternative embodiment of demolition hammer according to the present invention.

Turning now to FIG. 6, there is shown a demolition hammer 106 according to a third disclosed embodiment of the present invention. The demolition hammer 106 has a hammer head 42 attached to an outer end of a hammer spring 107 comprising a cantilever spring which may be tapered in thickness as with the spring 40 of the first embodiment, or which alternatively may be of uniform thickness throughout its length as shown in FIG. 6. The near end 108 of the hammer spring 107 is secured within the adapter bracket 31*b* which attaches to a conventional backhoe in place of the bucket. The hammer spring 107 is pivotably attached to the adapter bracket 31*b*, unlike the rigid attachment between the hammer spring and adapter bracket for the embodiment shown in FIGS. 1–4. This pivotable attachment is obtained by the hinge pin 110 extending through openings in the side plates 111 and 112 of the adapter bracket 31*b* and held in place with the hammer spring 107 by the U-shaped strap 113 which wraps around the hinge pin and engages the top and bottom surfaces of the hammer spring contiguous to the near end 108.

The hammer spring 107 extends rearwardly from the open back end 115 of the adapter bracket 31*b*. Two pairs of compression springs 116 and 117 maintain the pivotably mounted hammer spring 107 at a nominal attitude relative to the adapter bracket 31*b*. The upper pair of springs 116 extend between the fixed plate 118 at the top of the back end 115 and the slidable plate 119 which abuts the top surface of the hammer spring 107. In a similar manner, the lower pair of springs 117 are compressed between the bottom plate 120 of the adapter bracket 31*b* and the slidable plate 121 abutting the underside of the hammer spring 107. The springs 116 and 117 fit loosely around the vertical rods 124 and 125 extending between the fixed plate 118 at the top of the adapter bracket 31*b* and the bottom plate 120, so as to maintain the springs in fixed vertical relation to the slidable plates 119 and 121. The rods 124 and 125 freely pass through openings within the slidable plates 119 and 121, thereby retaining the slidable plates in position relative to the back end 115 of the adapter bracket 31*b* without impeding the vertical movement of the slidable plates.

The demolition hammer 106 works in much the same manner as the demolition hammer 10 described above, with operation of the backhoe alternatively raising and lowering the hammer head 42 with a whipping motion imparted by the flexibility of the hammer spring 107. This whipping motion in the demolition hammer 106 is enhanced by the pivotable attachment between the hammer spring 107 and the adapter bracket 31, and by the springs 116 and 117 which limit and control the pivotable movement of the hammer spring.

It should be understood that the foregoing relates only to preferred embodiments of the present invention, and that numerous changes and modifications may be made without departing from the spirit and scope of the invention as defined in the following claims.

We claim:

1. A hammer apparatus for attachment to a machine such as a backhoe or the like having an implement attached at an end of an articulated arm, the apparatus comprising:

adapter means selectively attachable to the arm in place of the implement;

a cantilever spring having one end mounted for pivotable movement relative to the adapter means and extending outwardly therefrom to a remote end;

impact tool means disposed at the remote end of the cantilever spring for impacting a workpiece as the articulated arm moves the adapter means; and secondary spring means urging the cantilever spring to a predetermined nominal pivotable attitude relative to the adapter means and resiliently yielding to permit the cantilever spring a limited pivotable movement as the adapter means is moved;

the cantilever spring being sufficiently elastic to impart a whipping action as the cantilever spring moves the impact tool towards the workpiece, so that the whipping action intensifies the impact delivered to the workpiece by the tool.

2. Apparatus as in claim 1, wherein:

the adapter means comprises a pair of sides flanking the cantilever spring;

means associated with the sides to mount the cantilever spring for said pivotable movement relative to the sides; and the secondary spring means urges the cantilever spring to a nominal pivotable position between the sides.

3. Apparatus as in claim 2, wherein:

the secondary spring means comprises a coil spring having one end fixed in relation to the sides and having another end operative to urge the cantilever spring to the nominal position between the sides.

4. Apparatus as in claim 2, wherein the secondary spring means comprises:

a first spring having one end fixed in relation to the sides and having another end urging the cantilever spring in a first direction between the sides; and a second spring having one end fixed in relation to the sides and having another end urging the cantilever spring in an opposed second direction between the sides, so that the opposed forces of the first and second springs determine the nominal pivotable position of the cantilever spring.

5. Apparatus as in claim 4, wherein the first and second springs comprise coil springs operative in compression to urge the cantilever spring to the nominal position.

6. Apparatus as in claim 1, wherein:

the secondary spring means comprises a compression spring urging the cantilever spring for pivotable movement toward the workpiece; and the secondary spring means resiliently allows the cantilever spring to pivot and move when the impact tool strikes the workpiece.

* * * * *